US005875945A

United States Patent [19]

Roach

[11] Patent Number: 5,875,945

[45] Date of Patent: Mar. 2, 1999

[54] ATTACK REPELLENT DEVICE AND HOLDER

[76] Inventor: T. Christian Roach, 260 Willow Ave., Wayne, Pa. 19087

[21] Appl. No.: 768,009

[22] Filed: Dec. 13, 1996

[51] Int. Cl.[6] ..... A41D 19/00

[52] U.S. Cl. ..... 224/217; 224/218; 224/251; 222/183; 222/192; 294/149

[58] Field of Search ..... 224/217, 218, 224/251, 914; 222/78, 175, 183, 192; 294/149, 150, 151; 482/47, 48; 206/37, 161; 74/558

[56] References Cited

U.S. PATENT DOCUMENTS

| | | | |
|---|---|---|---|
| D. 369,453 | 5/1996 | Robbins | D22/117 |
| 4,463,879 | 8/1984 | Des Voignes | 222/175 |
| 4,504,980 | 3/1985 | Butcher | 2/160 |
| 5,058,885 | 10/1991 | Brant | 482/48 |
| 5,088,121 | 2/1992 | Wallace | 2/160 |
| 5,146,810 | 9/1992 | Mueller | 74/558 |
| 5,287,995 | 2/1994 | Redman et al. | 222/175 |
| 5,318,492 | 6/1994 | Quinn | 482/108 |
| 5,325,997 | 7/1994 | Washington et al. | 222/175 |
| 5,332,119 | 7/1994 | Davis | 222/78 |
| 5,351,868 | 10/1994 | Beletsky et al. | 224/914 |
| 5,484,085 | 1/1996 | Bennett | 222/175 |

*Primary Examiner*—David J. Walczak
*Assistant Examiner*—Timothy L. Maust
*Attorney, Agent, or Firm*—Panitch Schwarze Jacobs and Nadel, P.L

[57] ABSTRACT

An attack repellent holder for securing an attack repellant device to a user's hand is provided. The attack repellant device includes a canister of attack repellent. The attack repellant holder includes a body having a cavity defined therein. The cavity is adapted for a close conforming fit to an exterior portion of the canister of attack repellent. A plurality of finger rings are attached to the body. The finger rings are positioned such that a user's fingers can be inserted in the finger rings to secure the device to a user's hand.

16 Claims, 4 Drawing Sheets

Fig. 2
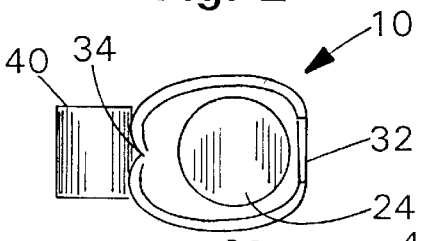
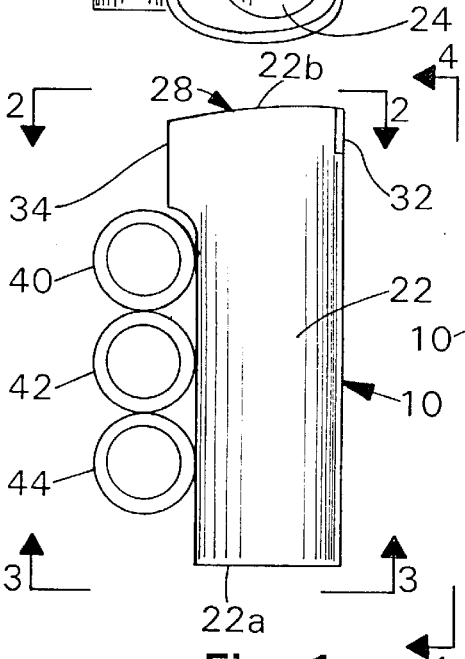
Fig. 1
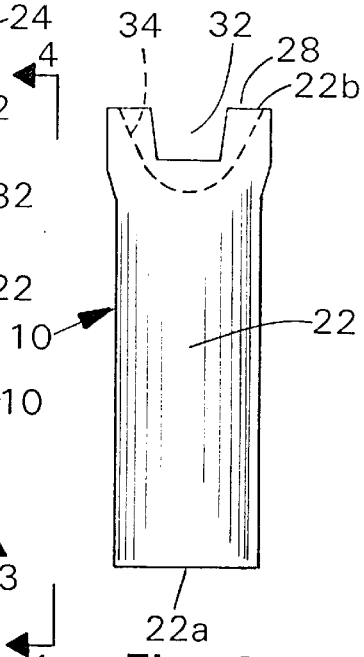
Fig. 4
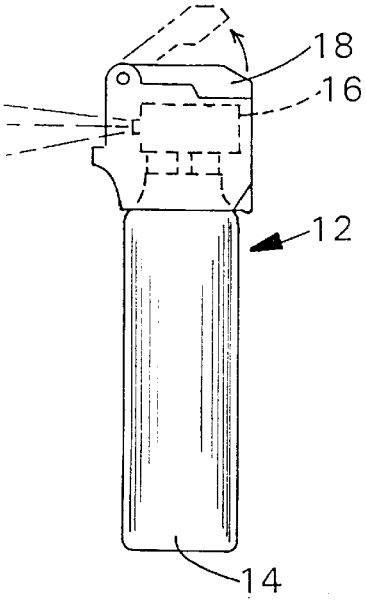
Fig. 5
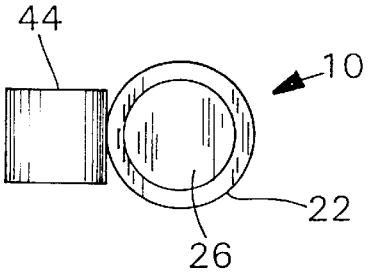
Fig. 3

ATTACK REPELLENT DEVICE AND HOLDER

BACKGROUND OF THE INVENTION

The present invention relates to attack repelling devices, and more particularly to hand-held repellent sprays such as mace, tear gas or pepper gas.

The use of small pressurized hand-held canisters containing tear gas, mace, pepper gas or other attack repellent materials for producing an incapacitating effect on an attacker have gained rapid popularity. However, in order to be effective, the device must be readily accessible and easily directed so that a user can have adequate time to use the device prior to or during an attack. If the device is not accessible, it is likely that an attack would be completed prior to the victim being able to use the device, and sometimes the device can be taken by the attacker and used against the victim.

In order to provide readily available attack repellent devices, key chains holders were developed which include small tear gas dispensers or audio alarms. This allows the deterrent to be available whenever the keys are carried. However, when a user does not have their keys in hand, or if the keys are removed or dropped from a user's hands, then this type of device becomes ineffective.

With the rise of street crimes, it would be desirable to provide an attack repellent device which can be easily carried outdoors, especially by walkers, joggers, bike riders, cross country skiers, skaters, and others while they exercise. One known device allows an attack repellent to be secured to a user's hand by providing an elastic strap which is wrapped around the user's palm. The strap positions the attack repellent adjacent to the thumb so that the thumb can be used to activate the attack repellent device. However, this type of arrangement has certain drawbacks in that the user must move their thumb into an awkward position in order to trigger the attack repellent, and there is no natural or reflexive aiming of the device toward the attacker based on its position. Additionally, based on the position that the attack repellant is held in by the strap on the user's palm, it would be extremely difficult for a user to access an attack repellent canister having a protective cover over the triggering mechanism with one hand. It is also not possible for the user to grasp a bike handlebar, ski pole, water bottle, or other object with their hand based on the strap position.

Another known device provides a holder for an attack repellent in the form of a hand band which is strapped over a user's hand. However, the attack repellent canister is again secured to the palm area providing the same problems with respect to the ergonomics of actuating the device or using an attack repellent canister having a protective cover over the triggering mechanism to prevent accidental discharge.

Another known device incorporates an attack repellent into a jogging weight, with the attack repellent being located in the grip portion and being discharged through a trumpet area in the jogging weight. However, the jogging weight requires the user to constantly grip the weight, which could get knocked loose. Additionally, this may make it more difficult for a jogger to work loose an abdominal muscle cramp while jogging, which requires a jogger to hold their hand and arm on the cramping side loosely in order to allow the cramped muscle to relax.

It would be desirable to provide a more ergonomic attack repellent holder which is self-securing to a user's hand, which is also more ergonomic to allow easier access and use based on the position of the attack repellent and the holder, as well as provide a more visible warning to deter attackers.

BRIEF SUMMARY OF THE INVENTION

Briefly stated, the present invention is an attack repellent holder for securing an attack repellant device to a user's hand. The attack repellant device includes a canister of attack repellent. The attack repellant holder includes a body having a cavity defined therein. The cavity is adapted for a close conforming fit to an exterior portion of the canister of attack repellent. A plurality of finger rings are provided on the tubular body along the tubular body. The finger rings are positioned such that a user's fingers can be inserted in the finger rings to secure the device to a user's hand.

In another aspect, the present invention provides an attack repellent device and holder which is adapted to be secured to a user's hand, which includes a canister containing a pressurized attack repellent, and a trigger mechanism for releasing the attack repellent attached to a first end of the canister. A tubular body is provided having a cavity defined therein. The cavity is adapted for close conforming fit to an exterior portion of the canister. The canister is located in the cavity with the trigger mechanism being positioned outside of the cavity. A plurality of flexible finger rings are attached to the tubular body along the tubular body. The finger rings are positioned such that a user's fingers can be inserted in the finger rings to secure the device to a user's hand, with the tubular body and the canister being located on a palm side of the user's hand. The finger rings are elastically expandable upon insertion of the user's fingers such that the device is self-securing on the user's hand in a first, non-use position, and the trigger mechanism can be rotated toward the user's thumb for activation by closing the fingers to grip the tubular body in a second, in-use position.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings:

FIG. 1 is an elevational view of an attack repellent holder in accordance with the present invention;

FIG. 2 if a top view taken along lines 2—2 in FIG. 1 ;

FIG. 3 is a bottom view taken along lines 3—3 in FIG. 1;

FIG. 4 is a right side elevational view of the attack repellent holder taken along lines 4—4 in FIG. 1;

FIG. 5 is an elevational view of an attack repellent device in accordance with the present invention;

DETAILED DESCRIPTION OF THE INVENTION

Figure 6:
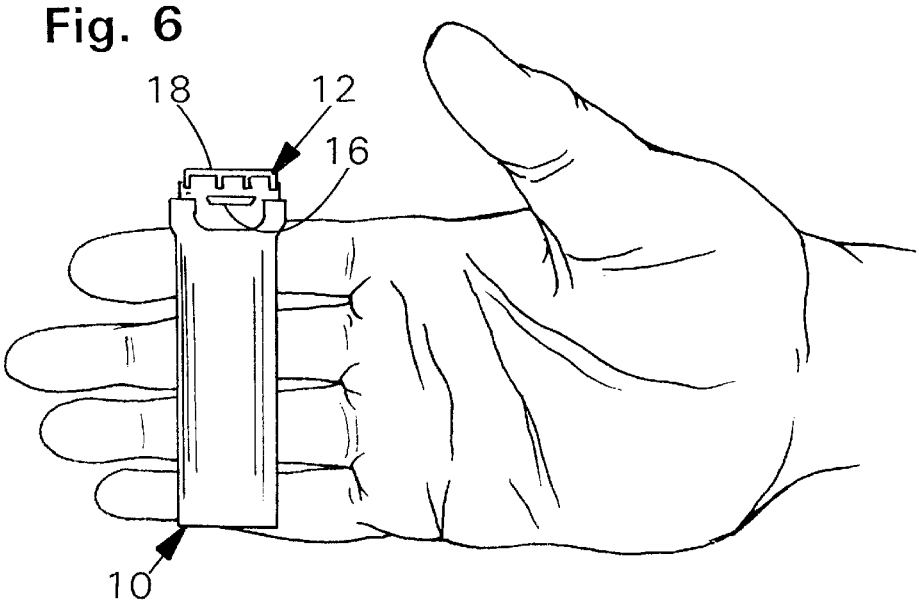
FIG. 6 is an elevational view of an attack repellent holder secured to a user's hand in a first position.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the attack repellant device and holder and designated parts thereof. The terminology includes the words above specifically mentioned, derivatives thereof and words of similar import.

Referring to the drawings, wherein like numerals indicate like elements throughout, there is shown in FIGS. 1–4 an attack repellent holder 10 for securing an attack repellent device 12, such as that shown in FIG. 5, to a user's hand. Preferably, the attack repellent device 12 includes a canister 14 for containing pressurized attack repellent, such as mace, pepper spray or tear gas. A trigger mechanism 16 for releasing the attack repellent is attached to a first end of the canister 14. A trigger guard 18 is preferably positioned above the trigger mechanism 16 to prevent an inadvertent discharge of the attack repellent. Preferably, the trigger guard 18 can be pivoted from the closed position to an open position (shown in phantom lines in FIG. 5). The attack repellent is discharged by pressing downwardly on the trigger mechanism 16. Those skilled in the art will recognize from the present disclosure that the attack repellent device 12 may vary in size and form and the specific type of attack repellent device utilized can be selected by the user to suit the individual user's needs.

Referring again to FIGS. 1–4, the attack repellent holder 10 includes a body 22 having a cavity 24 defined therein. The cavity 24 is adapted for close conforming fit to an exterior portion of the canister 14 of attack repellent. A bottom piece 26 is secured to a first end 22*a* of the body 22 to close off one end of the cavity 24, and a second end 22*b* of the body 22 includes an opening 28 which is adapted to receive the canister 14 of attack repellent. Preferably, the second end of the body includes first and second notches 32 and 34. The first notch 32 allows access to the trigger mechanism 16 by the user, and the second notch 34 provides clearance for the attack repellent which is released from the attack repellent device 12.

Preferably, the body 22 is tubular in form and is made of an elastic material. The second end 22*b* of the body 22 preferably conforms to the upper portion of the attack repellent device 12 and the cylindrical canister 14 is received within the cavity 24. In the preferred embodiment, the tubular body 22 is made of a flexible, preferably stretchable, cloth-covered foam material such as neoprene or any other suitable dense foam material. The preferred material provides a cushion grip for the user and holds the attack repellent device 12 firmly in position based on the elastic properties of the material. However, it will be recognized by those skilled in the art from the present disclosure that other types of material, such as woven flexible or elastic materials or polymeric materials, can be used to form the body 22, if desired. Additionally, the body 22 could be molded, cut or sculpted from a polymeric material to have an ergonomic grip surface or a smooth surface, depending on the user's needs.

Still with reference to FIGS. 1–4, a plurality of finger rings 40, 42, 44 are attached to the tubular body 22 along the tubular body 22. Preferably, the holder 10 includes at least three finger rings 40, 42, 44 attached to the body 22, with the second notch 34 being located above the first finger ring 40. The finger rings 40, 42, 44 are positioned such that a user's fingers can be inserted in the finger rings 40, 42, 44 to secure the holder 10 to a user's hand. As shown in FIGS. 6–11, in the first embodiment, the tubular body 22 is located within the user's hand with the body 22 being located on a palm side of the user's hand. Alternatively, as shown in the second embodiment of the invention 110, described in detail below, the tubular body 22 can be positioned adjacent to the user's knuckles, in brass knuckle fashion, to provide the user with the ability to grip another object in the hand with the attached holder 110.

The finger rings 40, 42, 44 are made of a flexible, preferably stretchable, cloth-covered foam material which is the same as the tubular body 22, and the finger rings 40, 42, 44 are elastically expandable such that upon insertion of the user's fingers, the holder 10 is self-securing on the user's hand. In the first embodiment of the holder 10, the body 22 is adapted to be located on a palm side of the user's hand. The finger rings 40, 42, 44 are preferably attached to the tubular body by stitching, heat staking, an adhesive, or any other suitable means. The finger rings 40, 42, 44 may also be molded or otherwise formed as one piece with the body 22. However, it will be recognized by those skilled in the art that other flexible or elastic materials may be used to form the finger rings 40, 42, 44, such as a woven elastic material or a knitted, inelastic polymeric material, if desired. Also, in addition to individual finger rings 40, 42, 44, the finger rings can be formed by a continuous strip attached to the tubular body 22 at spaced points, with the strip material looped between the attachment points to form finger rings. The strip material can be fixedly secured at the attachment points or made adjustable to slide through the attachment points and permit manual tightening of the loops by pulling on one end of the strip, prior to fastening the strip in the tightened position. The material strip may be fastened in the tightened position using VELCRO® or any other suitable fastening material or fastener.

Figure 7:
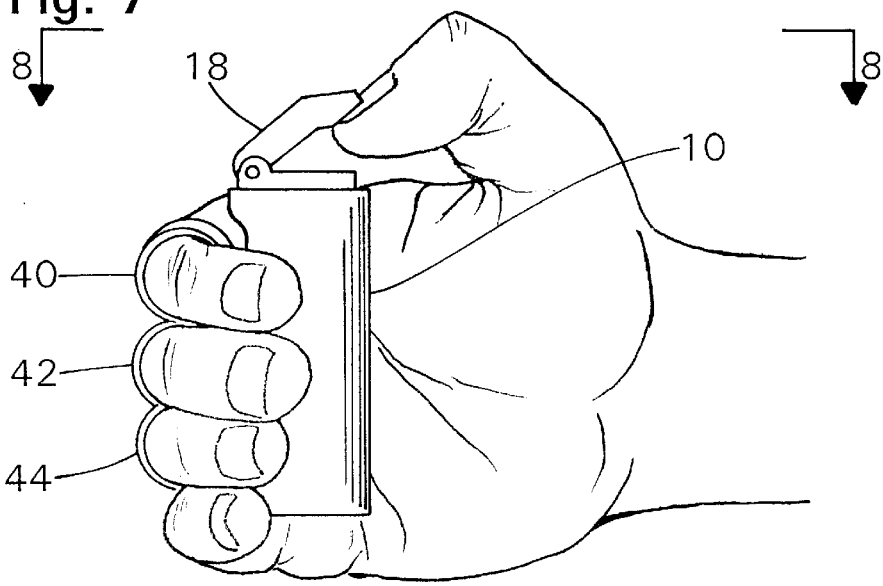
FIG. 7 is an elevational view similar to FIG. 6 of the attack repellent holder in an in-use position in a user's hand.
Figure 8:
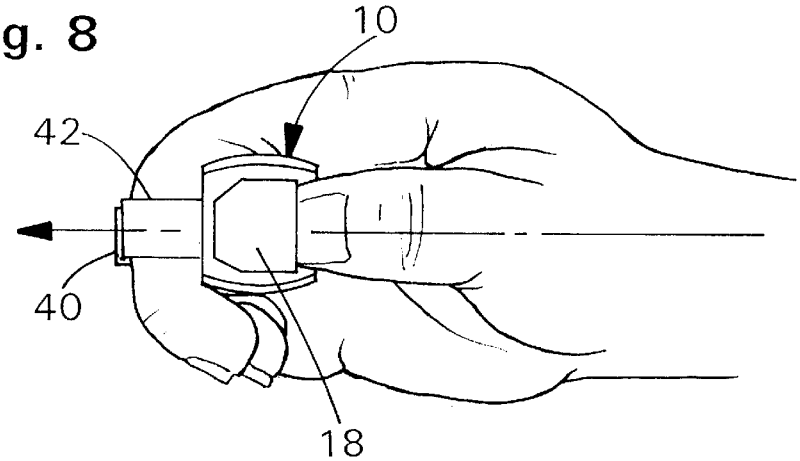
FIG. 8 is a top view of the attack repellent holder in the it-use position in a user's hand taken along lines 8—8 in FIG. 7.

In one preferred embodiment of the invention, illustrated in FIGS. 6–8, the finger rings 40, 42, 44 are sized to elastically grip the middle segments of a user's fingers. The holder 10 is self-securing on the user's hand in a first, non-use position, as shown in FIG. 6, and is held in place by the elastic finger rings 40, 42, 44 elastically gripping the middle segments of the user's fingers. The attack repellant device 12 and the trigger mechanism 16 can be rotated toward the user's thumb for activation, as shown in FIGS. 7 and 8, by the user closing his or her fingers to grip the tubular body 22 in a second, in-use position. In this position, the tubular body 22 is gripped by the user's fingers providing easy access for the user to flip up the trigger guard 18 with his or her thumb and actuate the trigger mechanism 16. This positioning of the attack repellant device 12 provides for ergonomic positioning in the user's hand and for natural pointing of the attack repellent device 12 in the direction of the user's hand and arm in a similar manner to pointing a handgun or clutching a fist. The closed fingers provide additional support for gripping the tubular body 22 as the attach repellent device 12 is discharged.

Figure 9:
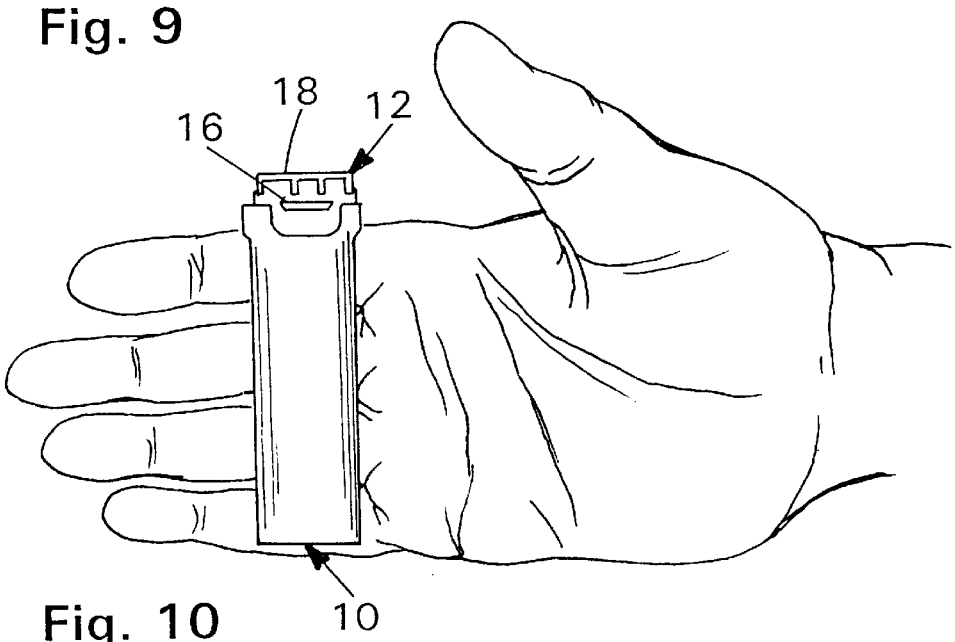
FIG. 9 is an elevational view of an attack repellent holder in a second position in a user's hand.
Figure 10:
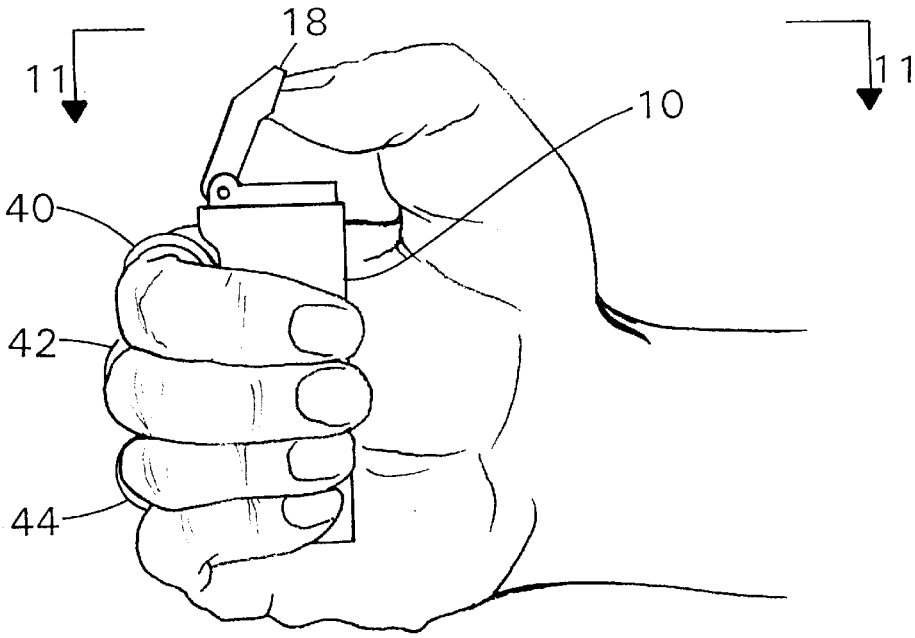
FIG. 10 is an elevational view similar to FIG. 9 of the attack repellent holder rotated from the second position to the in-use position in a user's hand.
Figure 11:
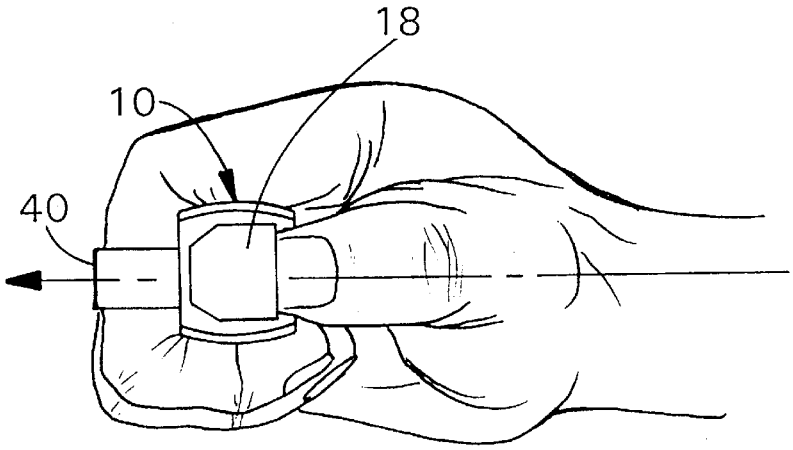
FIG. 11 is a top view of the attack-repellent holder in the in-use position in a user's hand taken along lines 11—11 in FIG. 10.

Depending upon the size of a user's hand, it is also possible to provide an attack repellent holder 10 wherein the finger rings 40, 42, 44 are sized to grip the segments of a user's fingers proximal to the palm, as shown in FIGS. 9–11. The finger rings 40, 42, 44 are self securing on the user's hands upon insertion of the user's fingers in a first, non-use position, as shown in FIG. 9. When required, the user can close his or her fingers such that the attack repellant device 12 and the trigger mechanism 16 are rotated towards the user's thumb as the user's fingers grip the tubular body 22 in a second, in-use position, shown in FIGS. 10 and 11. By sizing the finger rings 40, 42, 44 to grip proximal segments of a user's fingers, a more secure self-securing attachment to the user's hand is provided. This design still provides an ergonomic configuration which allows the holder and the attack repellent device 12 located in the holder 10 to be rotated toward the user's thumb as the user's hand closes to provide easy access to the trigger mechanism as well as allow the user to open the trigger guard 18 with relative ease. Again, the attack repellant device 12 is ergonomically positioned in the user's hand for natural pointing of the attack repellent device 12 in the direction of the user's hand and arm, in a similar manner to pointing a handgun.

Figure 12:
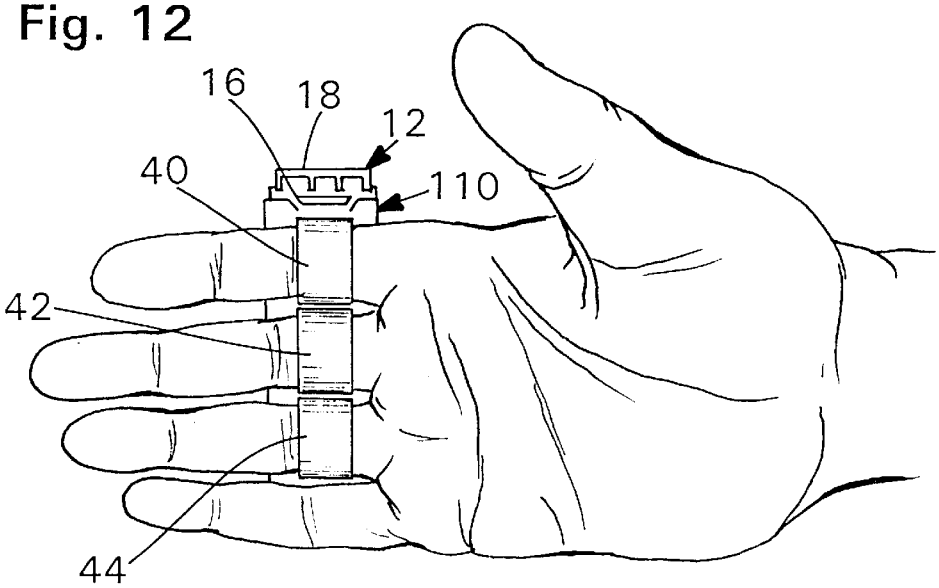
FIG. 12 is an elevational view of a second embodiment of an attack repellent holder attached to a user's hand.
Figure 13:
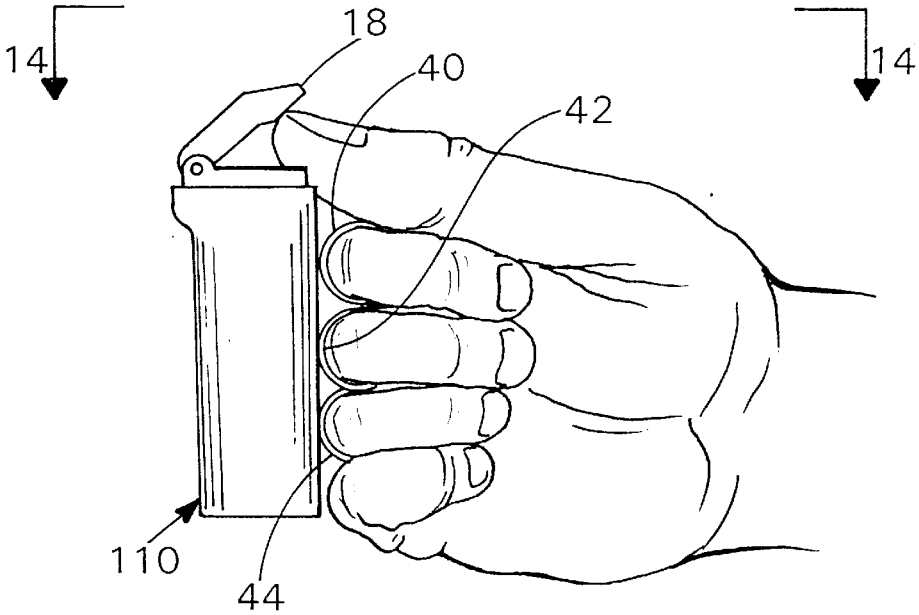
FIG. 13 is an elevational view similar to FIG. 9 of the attack repellent holder rotated to the in-use position in a user's hand.
Figure 14:
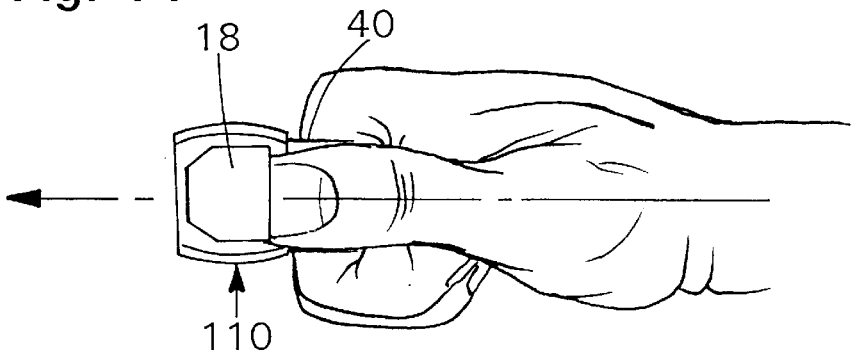
FIG. 14 is a top view of the attack-repellent holder in the in-use position in a user's hand taken along lines 14—14 in FIG. 13.

Referring now to FIGS. 12–14, the second embodiment of the holder 110 is shown in detail. The second embodiment of the holder 110 is identical to the first embodiment 10, except the finger rings 40, 42, 44 are attached or formed on the opposite side of the body 22, such that the holder 110 can be attached to the user's fingers with the body 22 being located on the outside of the user's fingers, brass knuckle style. This allows the user to freely grip other objects with the hand to which the holder 110 is attached, and provides a clearly visible deterent with the device being located on the outside of the user's hand.

Those skilled in the art will recognize that, depending on the configuration of the attack repellant device 12, the holder 110 can be identical to the holder 10, and can be reversed by the user when inserting their finger into the rings 40, 42, 44. The nozzle of the attack repellent device 12 is then rotated within the body 22 such that it points away from the user.

Again, the attack repellant device 12 and the trigger mechanism 16 can be rotated toward the user's thumb for activation, as shown in FIGS. 13 and 14, by the user making a fist to close the distance between the attack repellant device 12 and the user's thumb, moving the attack repellant device 12 to the second, in-use position and providing easy access for the user to flip up the trigger guard 18 with his or her thumb and actuate the trigger mechanism 16. This positioning of the attack repellant device 12 also provides for ergonomic positioning in the user's hand and for natural pointing of the attack repellent device 12.

It will be recognized by those skilled in the art from the present disclosure that the number of finger rings can be varied, if desired, and that two or four finger rings could be provided, and that it would be possible to provide finger rings in which more than one finger can be inserted. It will be similarly recognized that attachment of the holder 10 to the user's fingers provides for easier one handed operation of the attack repellent device and more ergonomic positioning of the attack repellent device 12 and holder 10 within the user's hand.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. An attack repellant holder for securing an attack repellant device to a user's hand, the attack repellant device including a canister of attack repellant, the attack repellant holder comprising:

a body having a cavity defined therein, the cavity being adapted for close conforming fit to an exterior portion of the canister of attack repellant; and a plurality of elastically expandable finger rings connected directly to the body adjacent to the cavity for receiving the canister of attack repellant, the finger rings being positioned such that a user's fingers can be inserted in the finger rings to secure the holder to the user's fingers such that the body is positioned transversely to the user's fingers.

2. The attack repellant holder of claim 1 wherein the body is adapted to be located on a palm side of the user's hand.

3. The attack repellant holder of claim 1 wherein the finger ring portions are elastically expandable such that upon insertion of the user's fingers, the holder is self-securing on the user's hand.

4. The attack repellant holder of claim 1 wherein the holder includes at least three finger rings attached to the body.

5. The attack repellant device of claim 1 wherein a bottom piece is secured to a first end of the body, and a second end of the body is adapted to receive the canister of attack repellant.

6. The attack repellant holder of claim 1 wherein the finger rings are sized to grip middle segments of a user's fingers.

7. The attack repellant holder of claim 1 wherein the finger rings are sized to grip segments of a user's fingers proximal to a palm of the user's hand.

8. The attack repellant holder of claim 1 wherein the body and the finger rings are made of a stretchable, cloth-covered foam material to provide a cushioned grip.

9. The attack repellant holder of claim 1 wherein the body is adapted to be located on a knuckle side of the user's hand.

10. An attack repellant device and holder which is secured to a user's hand, comprising:

a canister containing a pressurized attack repellant, and a trigger mechanism for releasing the attack repellant attached to a first end of the canister;

a tubular body having a cavity defined therein, the cavity being adapted for close conforming fit to an exterior portion of the canister, the canister being located in the cavity with the trigger mechanism being positioned outside of the cavity; and a plurality of finger rings connected directly to the tubular body, the finger rings being positioned such that a user's fingers can be inserted in the finger rings to secure the holder to a user's fingers, with the tubular body and the canister being oriented transversely to the user's fingers and being located on a palm side of the user's hand, the finger rings being elastically expandable upon insertion of the user's fingers such that the holder is self-securing to the user's fingers in a first, non-use position, and the trigger mechanism can be rotated toward the user's thumb for activation by closing the fingers to grip the tubular body in a second, in-use position.

11. The attack repellant holder of claim 10 wherein the holder includes at least three finger rings attached to the tubular body.

12. The attack repellant device of claim 10 wherein a bottom piece is secured to a first end of the tubular body, and a second end of the tubular body is adapted to receive the canister of attack repellant.

13. The attack repellant holder of claim 10 wherein the finger rings are adapted to grip middle segments of a user's fingers.

14. The attack repellant holder of claim 10 wherein the finger rings are adapted to grip segments of a user's fingers proximal a palm of the user's hand.

15. The attack repellant holder of claim 10 wherein the tubular body and the finger rings are made of a stretchable, cloth-covered foam material to provide a cushioned grip.

16. An attack repellant device and holder which is secured to a user's hand, comprising:

a canister containing a pressurized attack repellant, and a trigger mechanism for releasing the attack repellant attached to a first end of the canister;

a tubular body having a cavity defined therein, the cavity being adapted for close conforming fit to an exterior portion of the canister, the canister being located in the cavity with the trigger mechanism being positioned outside of the cavity; and a plurality of finger rings located directly on the tubular body, the finger rings being positioned such that a user's fingers can be inserted in the finger rings to secure the holder to the user's fingers, with the tubular body and the canister being located transversely to the user's fingers on a knuckle side of the user's hand, the finger rings being elastically expandable upon insertion of the user's fingers such that the holder is self-securing on the user's hand in a first, non-use position, and the trigger mechanism can be rotated toward the user's thumb for activation by closing the fingers to move the device to a second, in-use position.

* * * * *